US005313680A

United States Patent [19]

Ringler

[11] Patent Number: 5,313,680

[45] Date of Patent: May 24, 1994

[54] COMBINATION DRILLING AND WRENCHING TOOL

[76] Inventor: William G. Ringler, 50 Juniper Rd., Unit C-11, No. Attleboro, Mass. 02760

[21] Appl. No.: 868,554

[22] Filed: Apr. 14, 1992

[51] Int. Cl.[5] ..... B25F 3/00

[52] U.S. Cl. ..... 7/138; 7/158

[58] Field of Search ..... 7/158, 138, 901, 165

[56] References Cited

U.S. PATENT DOCUMENTS

| | | | |
|---|---|---|---|
| 2,671,369 | 3/1954 | Clark | 7/901 |
| 3,336,611 | 8/1967 | Schepp | 7/158 |
| 4,218,794 | 8/1980 | Seidel | 7/138 |

*Primary Examiner*—Roscoe V. Parker
*Attorney, Agent, or Firm*—Blodgett & Blodgett

[57] ABSTRACT

A combination drilling and wrenching tool which has three basic components, an inner housing for holding a drill bit, an intermediate housing for holding the inner housing, and an outer housing for holding the intermediate housing. The intermediate housing has an inner shank for insertion into the chuck of a power tool and a forward shank which has a bore for receiving the inner housing. The outer housing has a forwardly facing drive socket for wrenching and a rearwardly facing socket for receiving the forward shank of the intermediate housing in a rotary driving relationship. The outer housing has a bore which extends forwardly from the rearward socket for receiving the front end of a drill bit which is mounted in the inner housing. More specifically, a plurality of inner housings are utilized. Each inner housing has the same external cross-sectional dimension, but the inner housings have different horizontal bore sizes for accommodating drill bits of different sizes.

12 Claims, 4 Drawing Sheets

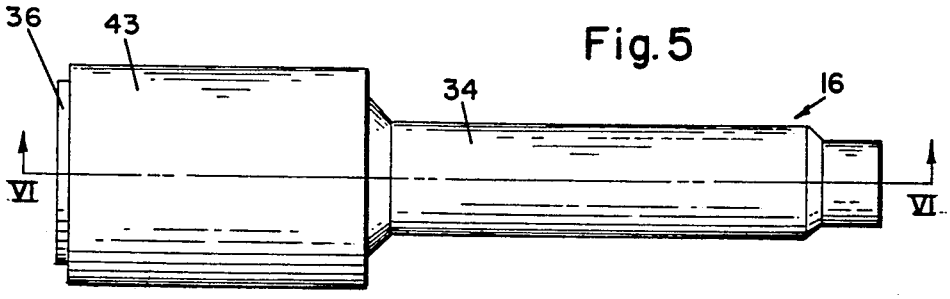
Fig. 5
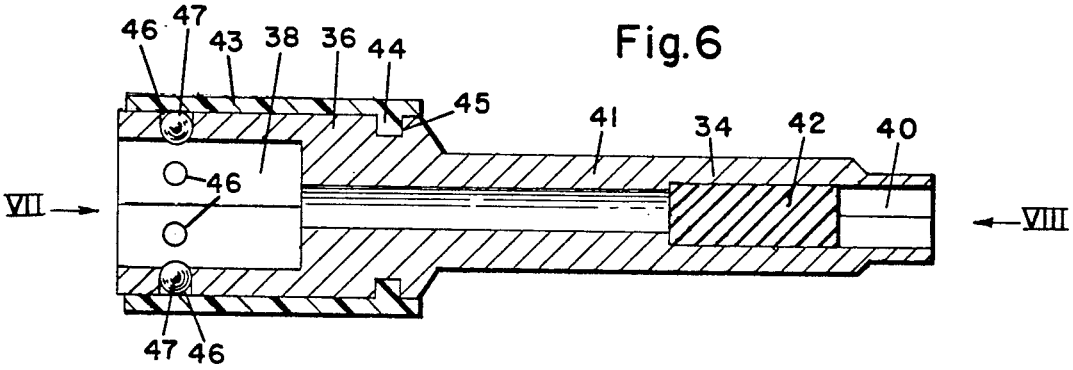
Fig. 6
Fig. 7
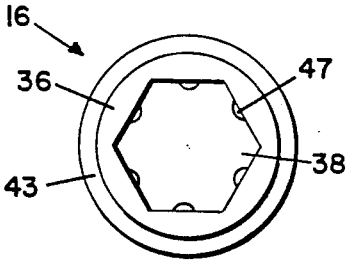
Fig. 8
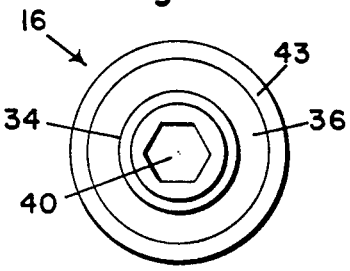

COMBINATION DRILLING AND WRENCHING TOOL

BACKGROUND OF THE INVENTION

The present invention is generally directed to an adapter for a drill and is particularly directed to a combination drilling and wrenching adapter.

In certain types of construction where items are fastened to an underlying support by the use of screws or lag bolts, pilot holes must be drilled for receiving the fastening elements. The most efficient way to drive the fastening element is by using a power drill. This means that a drill bit must be applied to the drill for making the hole and then the drill bit must be replaced by a fastening driving means such as a socket wrench or a driving head for a screw. As an alternative, a second drill can be used so that one drill is used for drilling the holes and the other drill is used for driving the fasteners.

A number of combination drilling and wrenching adapters have been developed for use with an electric drill. Each adapter has two operating states, the first state for drilling a hole and the second for driving a wrenching tool. The prior art adapters are divided into two basic groups. The first group of adapters consists of a combination drill bit holder and fastener driving tool assembly which remains in the assembled condition for drilling or fastener driving. The drill holding element is telescopically mounted within the fastener driving element for movement between an active position and an inactive position. Drilling occurs when the drill holding element is in the active position and wrenching occurs when the drill holding element is in the inactive position. The adapters of this first group are quite complicated and expensive. In each case, the adapter is limited to a specific drill bit or fastener driving tool.

The adapters of the second group are limited to a specific drill bit or fastener driving tool. These and other difficulties experienced with the prior art combination drill and wrenching adapters have been obviated by the present invention.

It is, therefore, a principle object of the invention to provide a combination drilling and wrenching tool which can be used for a wide range of drill bit sizes and wrenches.

Another object of this invention is the provision of a combination drilling and wrenching tool which is versatile and easy to use for drilling and wrenching.

A further object of the present invention is the provision of a combination drilling and wrenching tool which is simple in construction, which is inexpensive to manufacture, and which is capable of a long life of useful service.

A still further object of the invention is the provision of a drilling and wrenching tool which forms a countersink in a hole which is being drilled.

With these and other objects in view, as will be apparent to those skilled in the art, the invention resides in the combination of parts set forth in the specification and covered by the claims appended hereto.

SUMMARY OF THE INVENTION

In general, the invention consists of a combination drilling and wrenching tool which has three basic components, an inner housing for holding a drill bit, an intermediate housing for holding the inner housing, and an outer housing for holding the intermediate housing. The intermediate housing has an inner shank for insertion into the chuck of a power tool and a forward shank which has a bore for receiving the inner housing. The outer housing has a forwardly facing drive socket for wrenching and a rearwardly facing socket for receiving the forward shank of the intermediate housing in a rotary driving relationship. The outer housing has a bore which extends forwardly from the rearward socket for receiving the front end of a drill bit which is mounted in the inner housing. More specifically, a plurality of inner housings are utilized. Each inner housing has the same external cross sectional dimension, but each inner housing has a different horizontal bore size for accommodating drill bits of different sizes.

BRIEF DESCRIPTION OF THE DRAWINGS

The character of the invention, however, may be best understood by reference to one of its structural forms, as illustrated by the accompanying drawings, in which:

FIG. 5 is a top plan view of the outer housing portion of the combination drilling and wrenching tool of FIG. 1, FIG. 6 is a vertical cross-sectional view taken along the line VI—VI of FIG. 5 and looking in the direction of the arrows, FIG. 7 is an end elevational view of the outer housing and looking in the direction of arrow VII or FIG. 6, FIG. 8 is an end elevational view of the outer housing and looking in the direction of arrow VIII or FIG. 6.

DESCRIPTION OF THE PREFERRED EMBODIMENT

Figure 1:
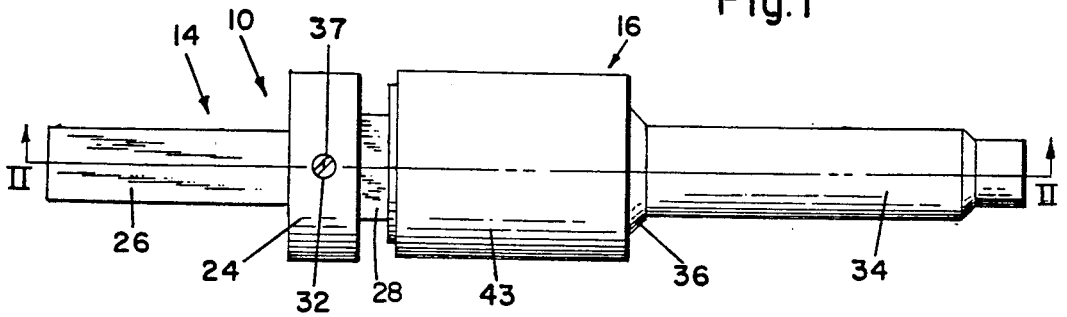
FIG. 1 is a plan elevational view of a combination drilling and wrenching tool embodying the principles of the present invention.
Figure 2:
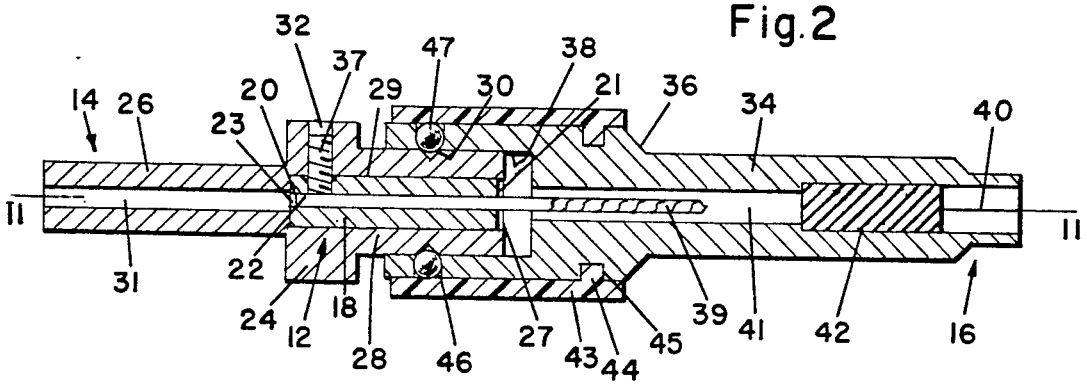
FIG. 2 is a vertical cross sectional view of the tool taken along the line II—II of FIG. 1.

Referring first to FIGS. 1 and 2, the drill adapter of the present invention is generally indicated by the reference numeral 10 and consists of three basic elements, an inner housing, generally indicated by the reference numeral 12, an intermediate housing, generally indicated by the reference numeral 14, and an outer housing generally indicated by the reference numeral 16.

Figure 3:
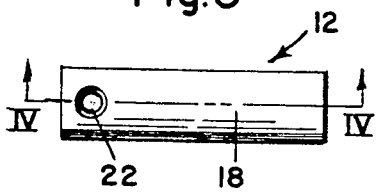
FIG. 3 is a top plan view of an inner housing which forms part of the tool of FIG. 1.
Figure 4:
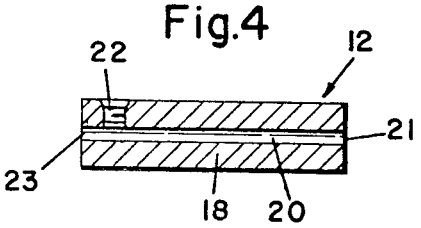
FIG. 4 is a vertical cross-sectional view of the inner housing taken along the line IV—IV of FIG. 3.
Figure 11:
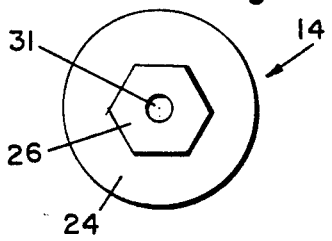
FIG. 11 is an end elevational view of the intermediate housing and looking in the direction of arrow XI or FIG. 10.
Figure 9:
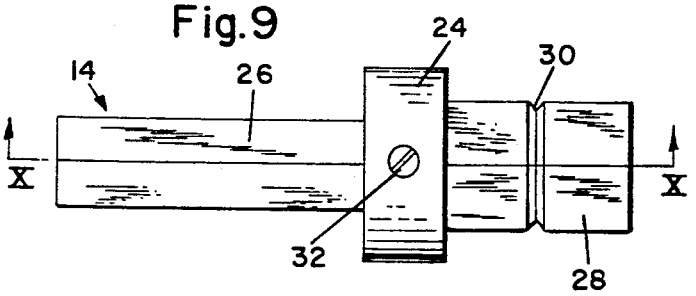
FIG. 9 is a top plan view of the intermediate housing which forms part of the combination drilling and wrenching tool of FIG. 1.

Referring particularly to FIGS. 3 and 4, the inner housing 12 comprises an elongated cylindrical body 18 which has a first cylindrical bore 20 which extends along the central longitudinal axis of the cylindrical body 18 from a rearward opening 23 to a forward opening 21. A first threaded aperture 22 extends transversely of the longitudinal axis from the bore 20 to the outer surface of the cylindrical body 18.

Figure 10:
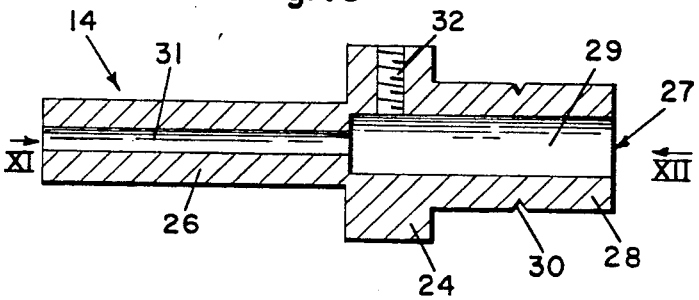
FIG. 10 is a vertical cross-sectional view taken along the line X—X of FIG. 9 and looking in the direction of the arrows.
Figure 12:
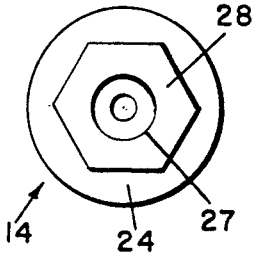
FIG. 12 is an end elevational view of the intermediate housing and looking in the direction of arrow XII of FIG. 10.

Referring particularly to FIGS. 9–12, the intermediate housing 14 consists of a cylindrical middle portion 24, a hexagonal rearward shank 26 which extends rearwardly from the cylindrical middle portion 24 and a forward hexagonal shank 28 which extends forwardly from the cylindrical middle portion 24. A second cylindrical bore 29 is located in the forward shank 28 and in the cylindrical portion 24 along the central longitudinal axis of the intermediate housing 14. A fourth axial bore 31 is located in the rearward shank 26 and extends rearwardly from the bore 29 along the central longitudinal axis of the intermediate housing 14. A second threaded aperture 32 extends transversely of the central longitudinal axis of the intermediate housing from the outer surface of the cylindrical middle portion 24 into the bore 29 as shown in FIG. 10. Each flat outer surface of the hexagonal second shank 28 has a groove 30 which extends transversely to the central longitudinal axis of the intermediate housing 14.

Figure 13:
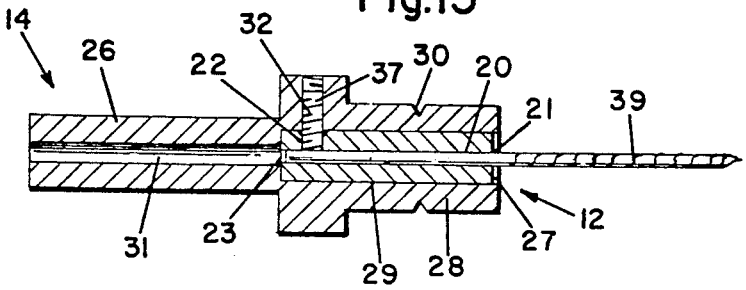
FIG. 13 is a vertical cross-sectional view similar to FIG. 2 with the outer housing removed from the intermediate housing.

Referring particularly to FIG. 13, the second bore 29 is adapted to receive the cylindrical body 18 so that the second aperture 32 is aligned with the first aperture 22 as shown in FIG. 2 and 13. When a drill bit 39 is inserted within the bore 20, it is locked in place by a set screw 37 which is threaded into the first and second apertures 32 and 22 and which engages the drill bit 29. The set screw 37 also mechanically locks the cylindrical body 18 to the intermediate housing 14. Although both of the apertures 22 and 32 are threaded, only one of the apertures needs to be threaded to fix the drill bit 39 to the inner housing 12 and to fix the inner housing 12 to the intermediate housing 14.

Referring particularly to FIGS. 5–8, the outer housing 16 comprises an elongated cylindrical forward portion 34 and an elongated cylindrical rearward portion 36. The diameter of the rearward portion 36 is substantially greater than the diameter of the forward portion 34. A relatively large hexagonal rearwardly facing socket 38 is located at the rearward end of the rearward portion 36. A relatively small hexagonal forwardly facing socket 40 is located at the forward end of the forward portion 34. A permanent magnet 42 is located at the rearward end of the forwardly facing socket 40. An elongated third bore 41 extends along the central longitudinal axis 11 of the outer housing 16 from the rearwardly facing socket 38 to the magnet 42. An outer sleeve 43 of flexible resilient plastic material is located on the rearward portion 36. The sleeve 43 has an inwardly directed flange 44 which extends into an annular outer groove 45 in the rearward portion 36, thereby locking the sleeve 43 to the rearward portion 36. The rearward portion 36 has a plurality of holes 46 which extend from the sleeve 43 to the socket 38. Each hole 46 contains a ball 47 which is biased by the sleeve 43 toward the socket 38 and which extends partially into the socket 38.

Referring to FIGS. 1 and 2, the forward shank 28 of the intermediate housing 14 is adapted to be inserted within the rearwardly facing socket 38 so that the balls 47 seat into the grooves 30 for restraining the intermediate housing 14 against axial movement within the outer housing 16. When all three housing portions 12, 14 and 16 are combined, the bores 29, 31, 20 and 41 are all co-axial about the central longitudinal axis 11 as shown in FIG. 2 so that the drill bit 39 extends into the bore 41. If an unusually long drill bit is utilized, the rearward end of the drill bit will extend into the bore 31.

During operation of the combination drilling and wrenching tool 10 of the present invention, the inner and intermediate housings 12 and 14, respectively, are combined as shown in FIG. 13 and the rearward shank 27 is inserted into the chuck of a conventional electric drill. This enables a hole to be drilled, as for example, through an attaching structure into a supporting structure. After the hole has been drilled, the outer housing 16 is attached to the intermediate housing 14 by inserting the forward shank 28 into the socket 38 as shown in FIGS. 1 and 2. The hexagonal shank of an appropriate fastener driving tool or socket wrench is then inserted into the forwardly facing socket 40 for driving a fastener such as a screw or lag bolt into the hole which has just been drilled for securing the attaching structure to the supporting structure. The housing 12 comprises a plurality of cylindrical bodies 18. Each cylindrical body 18 has a specific particular bore diameter 20 for accommodating a specific drill bit. All of the cylindrical bodies 18 have the same outer diameter so that they all fit relatively snugly within the bore 29 of the intermediate housing 14. This is a simple relatively inexpensive component of the tool. The tool can consists of several inner housings without significantly adding to the overall cost of the tool. At the same time, the plurality of inner housings enables the tool to accommodate all of the conventional drill bit sizes which are normally encountered for attaching structures to a supporting structure by the use of fasteners.

Figure 14:
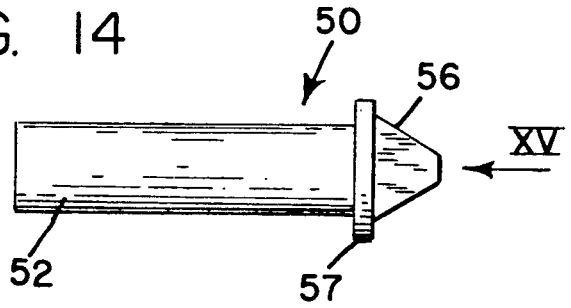
FIG. 14 is a side elevational view of a modified inner housing.
Figure 15:
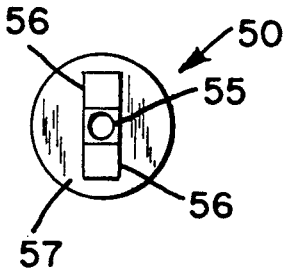
FIG. 15 is an end elevational view of the modified inner housing looking in the direction of arrow XV of FIG. 14.
Figure 16:
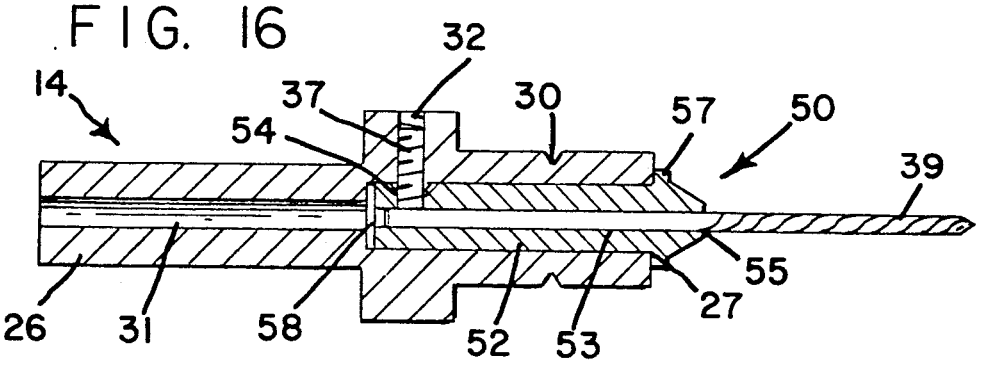
FIG. 16 is a vertical cross-sectional view which is similar to FIG. 13 showing the modified inner housing of FIG. 14 located within the intermediate housing of FIG. 10.

Referring to FIGS. 14–16, there is shown a modified inner housing which is generally indicated by the reference numeral 50. Inner housing 50 comprises an elongated cylindrical body 52 which has a first cylindrical bore 53 which extends along the central longitudinal axis of the cylindrical body 52 from a forward opening 55 to a rearward opening 58. A pair of external cutting edges 56 are located at the forward end of the body 52 and taper outwardly and rearwardly from the forward opening 55. A circular flange 57 is located at the rearward ends of the cutting edges 56. The flange 57 is located in a plane which is transverse to the central longitudinal axis of the body 52. The cutting edges 56 form a conical countersink at the outer end of a hole which is drilled by a drill bit which is located within the bore 53. The flange 57 functions as a stop for the drill. The flange 57 also functions as a locating element for correctly positioning the inner housing 52 within the intermediate housing 14 so that the apertures 54 and 32 are located in the same transverse plane. The cutting edges 56 are also aligned with the aperture 54 which helps to align the aperture 54 with the aperture 32 as shown in FIG. 16.

Clearly, minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed and desired to secure by Letters Patent is:

1. A combination drilling and wrenching tool for use with a power tool which has a chuck for gripping the shank of a tool, said drilling and wrenching tool comprising:

(a) an inner housing which has a central longitudinal axis, a first bore which extends along said axis, said first bore having a first forward opening for receiving the rear end of a drill bit so that the rear end of the drill bit lies in said first bore and the front end of the drill bit extends forwardly from said first forward opening along said axis, (b) first connecting means for releasably fixing the rear end of said drill bit to said inner housing, (c) an intermediate housing which has a rearward shank for insertion into the chuck of a power tool and a forward shank, said forward shank having a second bore which extends along said axis, said second bore having a second forward opening for receiving said inner housing so that the inner housing lies within said second bore and said first and second bores are coaxial, and the front end of a drill bit which is located within said first bore extends forwardly from said second forward opening, (d) second connecting means for releasably fixing said inner housing to said intermediate housing, (e) an outer housing having a forward portion and a rearward portion, said forward portion having a forward end which has a forwardly facing wrenching socket, said rearward portion having a rearwardly facing socket for receiving the forward shank of said intermediate housing, said outer housing having a third axial bore which extends along said central longitudinal axis from said rearwardly facing socket toward said forwardly facing socket and which is coaxial with said first and second bores for receiving the forwardly extending portion of said drill bit, and (f) coupling means for releasably coupling, said second shank to said rearwardly facing socket so that rotation of said intermediate housing about said axis causes rotation of said outer housing about said axis, whereby said combination drilling and wrenching tool is effective for drilling when said outer housing is removed from said intermediate housing and effective for wrenching when said outer housing is applied to said intermediate housing.

2. A combination drilling and wrenching tool as recited in claim 1, wherein said first connecting means comprises a threaded aperture in said inner housing which extends transversely of said axis from said first bore to the outside of said inner housing, and a set screw which is threaded into said aperture for engaging the shank of a drill bit which is located within said first bore.

3. A combination drilling and wrenching tool as recited in claim 1, wherein said second connecting means comprises a threaded aperture in the second shank of said intermediate housing which extends transversely of said axis from said second bore to the outside of said intermediate housing, and a set screw which is threaded into said aperture for engaging said inner housing.

4. A combination drilling and wrenching tool as recited in claim 1, wherein said first and second connecting means comprise a first aperture in said inner housing which extends to the outside of said inner housing transversely of said axis, a second aperture in the second shank of said intermediate housing which extends transversely of said axis from said second bore to the outside of said intermediate housing, said first and second apertures being axially alignable when said inner housing is located within said second bore, at least one of said first and second apertures being threaded, and a set screw which occupies said first aperture and at least a portion of said second aperture, said set screw being threaded in at least one of said apertures.

5. A combination drilling and wrenching tool as recited in claim 1, wherein said first axial bore has a rearward opening and wherein said rearward shank has a fourth axial bore which is axially aligned with said second axial bore and which extends into the end of said second axial bore which is opposite said second forward opening.

6. A combination drilling and wrenching tool as recited in claim 1, wherein said coupling means comprises:

(a) at least one flat outer surface on said forward shank which is parallel with and which faces away from said axis, and (b) at least one flat inner surface within said rearwardly facing socket which is parallel with and which faces toward said axis, said inner and outer surfaces abutting when said forward shank is located within said rearwardly facing socket.

7. A combination drilling and wrenching tool as recited in claim 1, wherein said forward shank is yieldably restrained against axial movement within said rearwardly facing socket by detent means.

8. A combination drilling and wrenching tool as recited in claim 7, wherein said detent means comprises:

(a) a depression in said outer flat surface, (b) a resilient sleeve on the rearward end of said outer housing, (c) a hole which extends from said inner flat surface to said resilient sleeve and which is aligned with said depression when said forward shank is located within said rearwardly facing socket, and (d) a ball which is located within said hole, the diameter of said ball being greater than the distance between said sleeve and said inner flat surface so that said ball is biased by said sleeve to project into said rearwardly facing socket and into said depression.

9. A combination drilling and wrenching tool as recited in claim 1, wherein a permanent magnet is located between said forwardly facing socket and said third axial bore.

10. A combination drilling and wrenching tool as recited in claim 1, wherein said tool has a plurality of inner housings, each inner housing having the same outer cross-sectional dimension so that each inner housing fits snugly within said second bore, the first bore of each of said inner housings differing in cross-sectional dimension front he first bore of each of the inner housings so that said tool can be used with a plurality of drill bit sizes.

11. A combination drilling and wrenching tool for use with a power tool which has a chuck for gripping the shank of a tool, said drilling and wrenching tool comprising:

(a) an inner housing which has a central longitudinal axis, a first bore which extends along said axis, said first bore having a first forward opening for receiving the rear end of a drill so that the rear end of the drill bit lies in said first bore and the front end of the drill bit extends forwardly from said first forward opening along said axis, said inner housing having at least one external cutting edge adjacent said first forward opening which tapers outwardly and rearwardly from said first forward opening for forming a conical countersink in a hole which is formed with said drill bit, (b) first connecting means for releasably fixing the rear end of said drill bit to said inner housing, (c) an intermediate housing which has a rearward shank for insertion into the chuck of a power tool and a forward shank, said forward shank having a second bore which extends along said axis, said second bore having a second forward opening for receiving said inner housing so that the inner housing lies within said second bore and said first and second bores are coaxial, and the front end of a drill bit which is located within said first bore extends forwardly from said second forward opening, (d) second connecting means for releasably fixing said inner housing to said intermediate housing, (e) an outer housing having a forward portion and a rearward portion, said forward portion having a forward end which has a forwardly facing wrenching socket, said rearward portion having a rearwardly facing socket for receiving the forward shank of said intermediate housing, said outer housing having a third axial bore which extends along said central longitudinal axis from said rearwardly facing socket toward said forwardly facing socket and which is coaxial with said first and second bores for receiving the forwardly extending portion of said drill bit, and (f) coupling means for releasably coupling, said second shank to said rearwardly facing socket so that rotation of said intermediate housing about said axis causes rotation of said outer housing about said axis, whereby said combination drilling and wrenching tool is effective for drilling when said outer housing is removed from said intermediate housing and effective for wrenching when said outer housing is applied to said intermediate housing.

12. A combination drilling and wrenching tool as recited in claim 11, wherein a flange is located between said cutting edge and said first forward opening, said flange extending transversely of said first axis to function as a drilling stop and a positioning stop for the inner housing within the intermediate housing.

* * * * *